United States Patent [19]

Mantione

[11] 4,010,695

[45] Mar. 8, 1977

[54] COKE QUENCHING CAR CLOSURE MECHANISM

[75] Inventor: Anthony F. Mantione, Bethlehem, Pa.

[73] Assignee: Bethlehem Steel Corporation, Bethlehem, Pa.

[22] Filed: May 8, 1975

[21] Appl. No.: 575,843

Related U.S. Application Data

[62] Division of Ser. No. 516,043, Oct. 18, 1974, Pat. No. 3,924,543.

[52] U.S. Cl. ..... 105/254; 49/67; 105/240; 105/263; 105/280; 220/259; 222/545

[51] Int. Cl.[2] ..... B61D 3/04; B61D 3/16; B61D 7/08; B61D 9/12

[58] Field of Search ..... 49/62, 67; 105/243, 105/254, 255, 257, 378, 240, 263, 280; 160/90; 220/256, 259, 371, 372; 222/178, 189, 504, 545

[56] References Cited

UNITED STATES PATENTS

| | | | |
|---|---|---|---|
| 292,336 | 1/1884 | Madeira | 49/67 X |
| 439,465 | 10/1890 | Bochkoltz | 105/257 |
| 538,092 | 4/1895 | Wanner, Jr. | 222/545 |
| 734,592 | 7/1903 | McClellon | 202/227 |
| 1,065,081 | 6/1913 | Reubold | 202/263 X |
| 1,077,255 | 11/1913 | Brunner et al. | 202/263 X |
| 1,105,948 | 8/1914 | Wright | 105/254 |
| 1,121,376 | 12/1914 | Koppers | 202/263 X |
| 1,169,790 | 2/1916 | Fowler, Sr. | 105/257 |
| 1,317,253 | 9/1919 | Wright | 105/254 |
| 1,365,974 | 1/1921 | Flood et al. | 202/227 |
| 1,483,893 | 2/1924 | Kipp | 105/254 |
| 1,645,587 | 10/1927 | Chalmers | 105/254 |
| 2,186,700 | 1/1940 | Johnson | 105/243 |
| 2,232,116 | 2/1941 | Koppers | 202/227 |
| 2,753,051 | 7/1956 | Tupper | 222/189 X |
| 2,795,539 | 6/1957 | Hughes | 202/228 X |
| 3,099,229 | 7/1963 | Wethly | 105/254 |
| 3,257,145 | 6/1966 | Case et al. | 105/255 X |
| 3,788,236 | 1/1974 | Edgar et al. | 105/254 |
| 3,801,472 | 4/1974 | Kemmetmueller | 202/227 X |
| 3,924,543 | 12/1975 | Mantione | 105/257 |

*Primary Examiner*—Robert J. Spar
*Assistant Examiner*—Howard Beltran
*Attorney, Agent, or Firm*—Joseph J. O'Keefe; Michael J. Delaney; John J. Selko

[57] ABSTRACT

A coke quench car having a slanted bottom and discharge opening in one wall is provided with a movable grate at the discharge opening to drain water and retain coke. A door outboard of the grate closes the discharge opening in a substantially liquid-tight condition and accumulates quench water in the car to submerge the coke. Means are provided for selectively opening the door to drain only water at the quench station and for later opening the grate to discharge the quenched coke at the coke wharf.

A second embodiment provides a tilting bottom coke car with a first sealing means for sealing the car in substantially liquid-tight condition to accumulate water and submerge the coke. A second sealing means are provided to permit the floor to be tilted to a liquid discharge position to drain only water. Means are provided for tilting the floor between an open and closed and intermediate liquid discharge position.

4 Claims, 5 Drawing Figures

FIG. 5
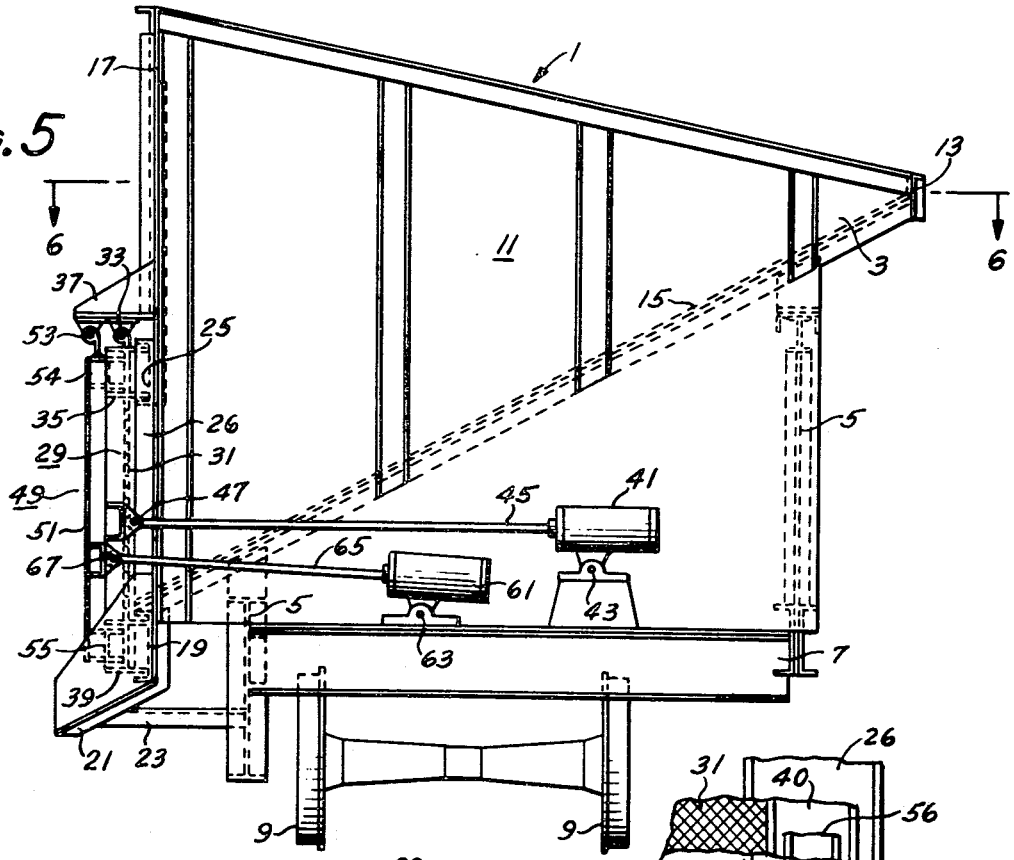
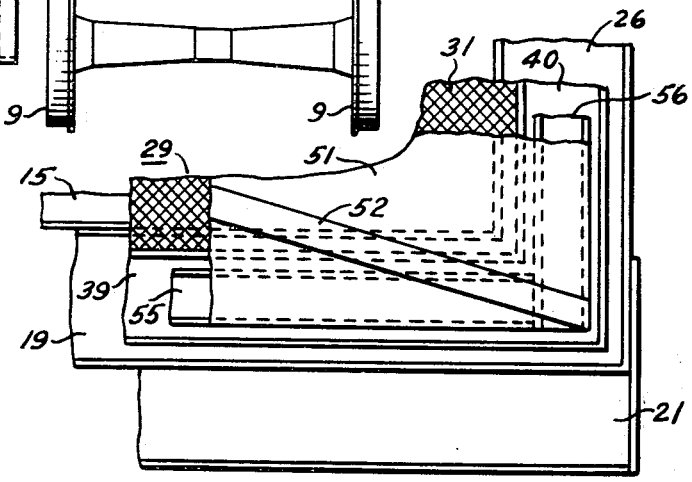
FIG. 7
FIG. 6
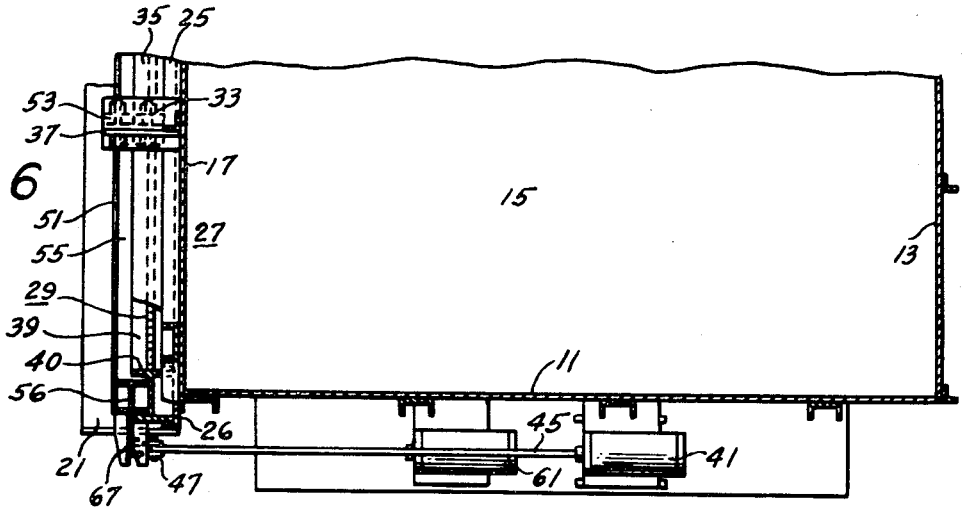

FIG. 8
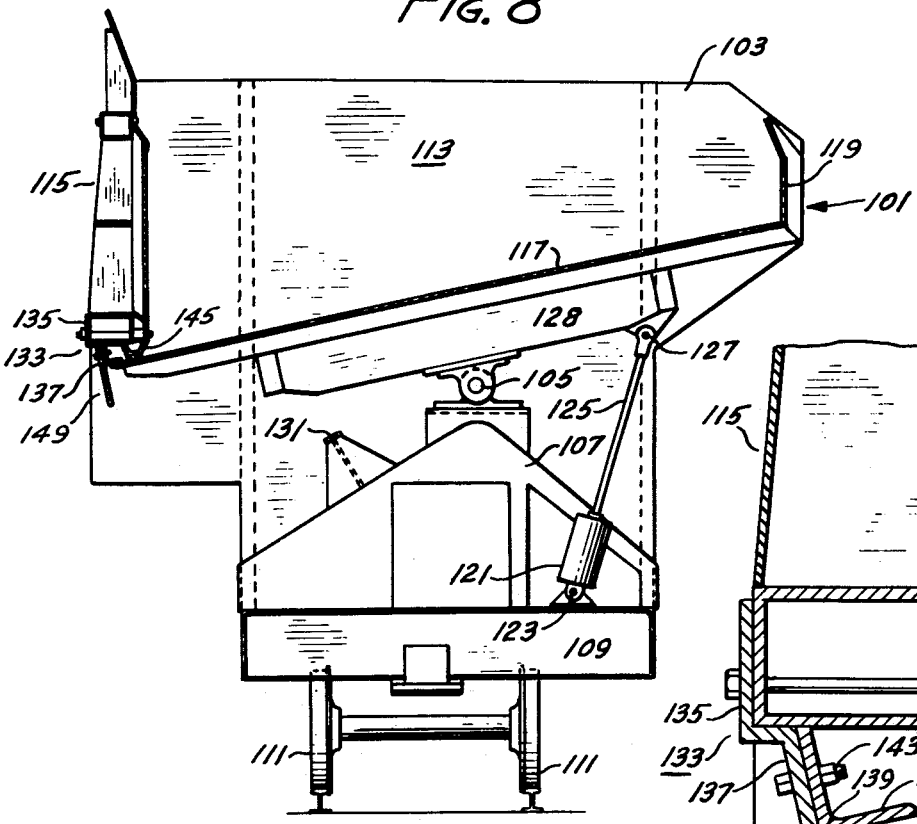
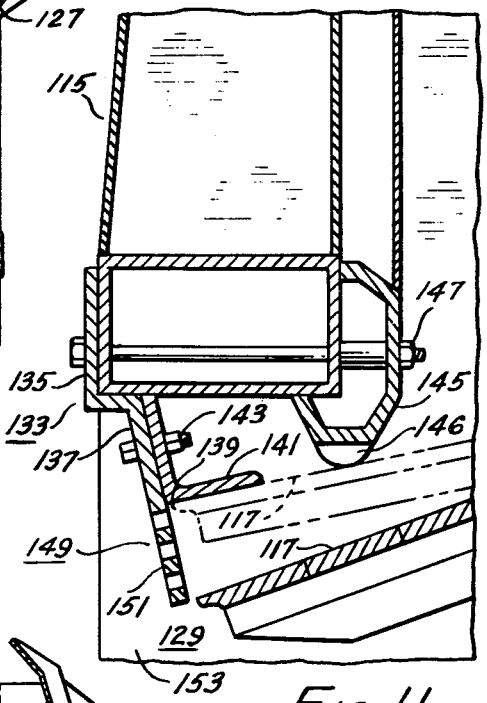
FIG. 11
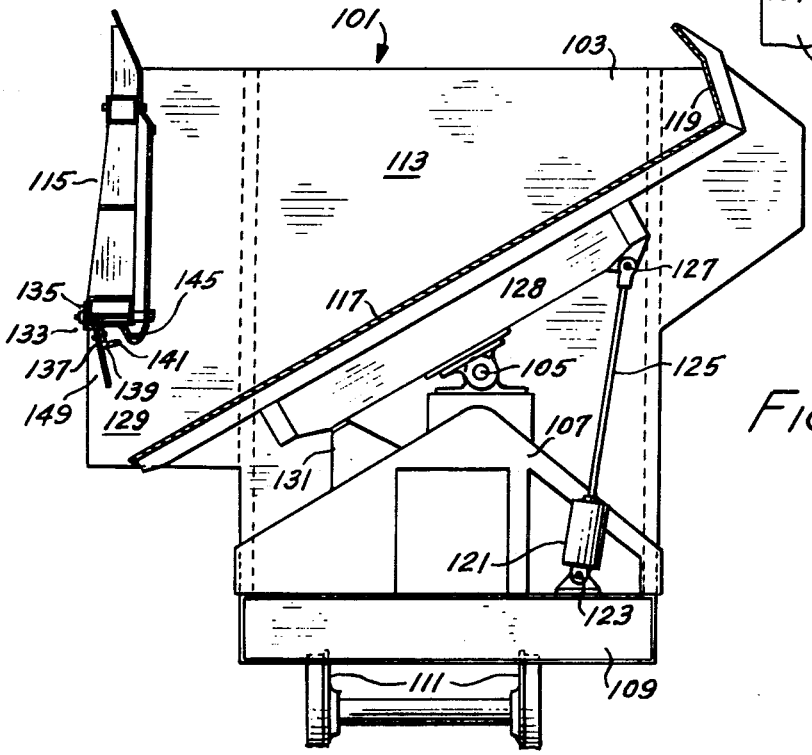
FIG. 9

COKE QUENCHING CAR CLOSURE MECHANISM

This application is a division of copending application Ser. No. 516,043, filed Oct. 18, 1974, now U.S. Pat. No. 3,924,543, issued Dec. 9, 1975.

BACKGROUND OF THE INVENTION

This invention relates to coke quench cars of the type having a slanted bottom and discharge opening in one wall and also of the type having a tilting floor discharge.

In the quenching of incandescent coke, quench cars are designed to avoid accumulation of water in the coke container or basket. A problem with the prior art coke quenching is that the car is designed so that the quench water drains off rapidly and therefore quenches unevenly because coke is not distributed at a uniform depth throughout the car. Also, varying amounts of moisture are introduced to the coke because the surface coke layers receive more exposure to water than the middle and lower coke layers more exposure to water than the middle and lower coke in the car. Moisture content also varies from quench to quench because of the non-uniform depth of the coke. Uneven quenching and variable moisture content of the coke can lead to variable coke properties which can cause problems in later operations such as blast furnace refining operations where coke is fed to the furnace at an assumed moisture content.

Up to the present, fully submerging of coke in water for quenching has required extensive new and different auxiliary equipment requiring major modification to the original system, all of which is expensive.

Therefore, there is a need for a coke quench car which can fully submerge the coke to quench it uniformly and to provide coke with a relatively constant moisture content from quench to quench, which car can selectively drain the water and coke at different stations. There is a need for such a quench car which can be supplied with relatively inexpensive modifications of existing equipment.

SUMMARY OF THE INVENTION

I have discovered that the prior art problems can be solved with a quench car having a slanted bottom and a discharge opening at one wall in which grate means, movable between an open and closed position, are provided at the discharge opening to retain coke and drain water in the closed position and discharge the quenched coke in the open position. Closure means are provided adjacent the grate means for closing the discharge opening in a substantially liquid-tight condition to accumulate quench water in the car. Means are provided for selectively opening and closing the grate means and closure means.

In a second embodiment, a coke quench car having a tilting floor discharge is provided with a first sealing means adjacent the lower edge of the front wall for contacting the edge of the floor in a substantially liquid-tight condition to retain both water and coke. A second sealing means are provided adajacent the first sealing means for discharging water and retaining coke when the floor is in a liquid draining position. Means are provided for moving the floor between an open position, a closed position and an intermediate liquid draining position.

BRIEF DESCRIPTION OF THE DRAWINGS

FIG. 5 is a side view of the car of FIG. 4.

FIG. 6 is a view along lines 6—6 of FIG. 5 showing the end portion of the car.

FIG. 7 is an enlarged detail of a bottom corner of the grate and door in the closed position.

FIG. 8 shows an end view of a tilt bottom discharge coke car in cross section with parts removed, with the floor in closed position.

FIG. 9 shows the car of FIG. 8 with the floor in the open position.

FIG. 11 is an enlarged view of the first and second sealing means for the tilt bottom quench car with the floor in a liquid draining position.

DESCRIPTION OF THE PREFERRED EMBODIMENTS

Figure 1:
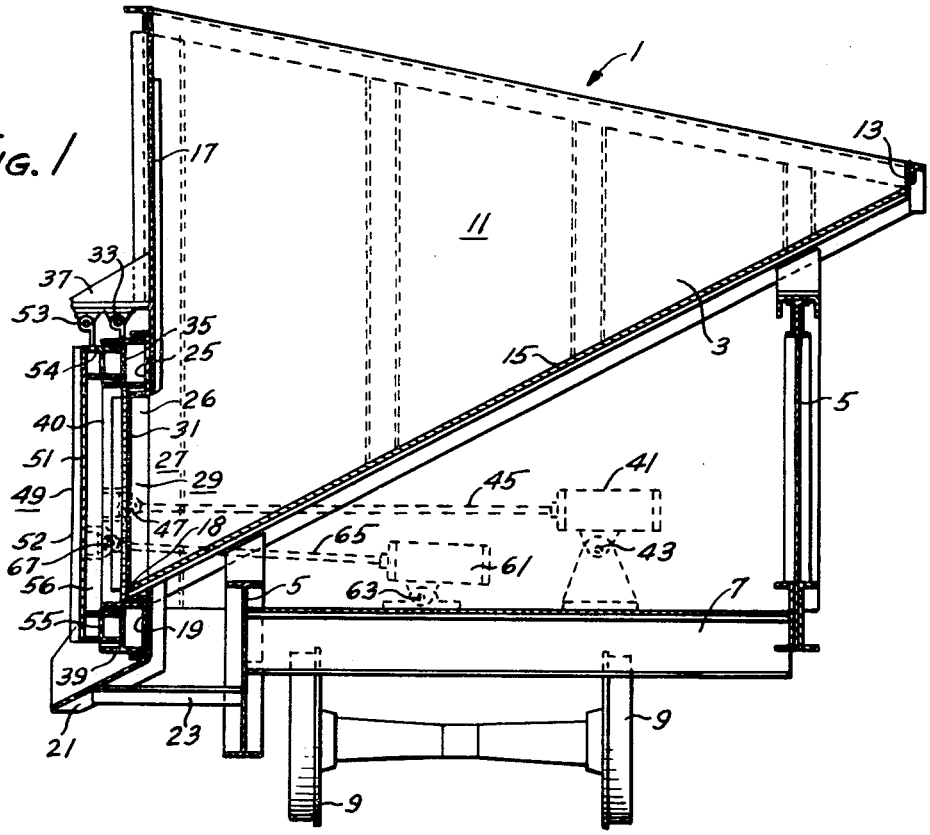
FIG. 1 shows an end view of a slanted bottom coke car in cross section, with parts removed, and the grate and door in the closed position.

Referring to the drawings, FIG. 1 shows a coke quench car 1 with a coke basket 3 supported by members 5 on support frame 7 which is mounted on wheels 9. Coke basket 3 includes a pair of spaced end walls 11 connected to frame 7, a back wall 13 extending between end walls 11, a slanted floor 15 extending between end walls 11 and a front discharge wall 17 extending between end walls 11. Slanted floor 15 has front edge 18 forming a lip and a channel bar 19 adjacent front edge 18 extending the full length of front edge 18, with an extension 21 which angles outwardly and downwardly. Angle member 23 is added for rigidity.

Figure 4:
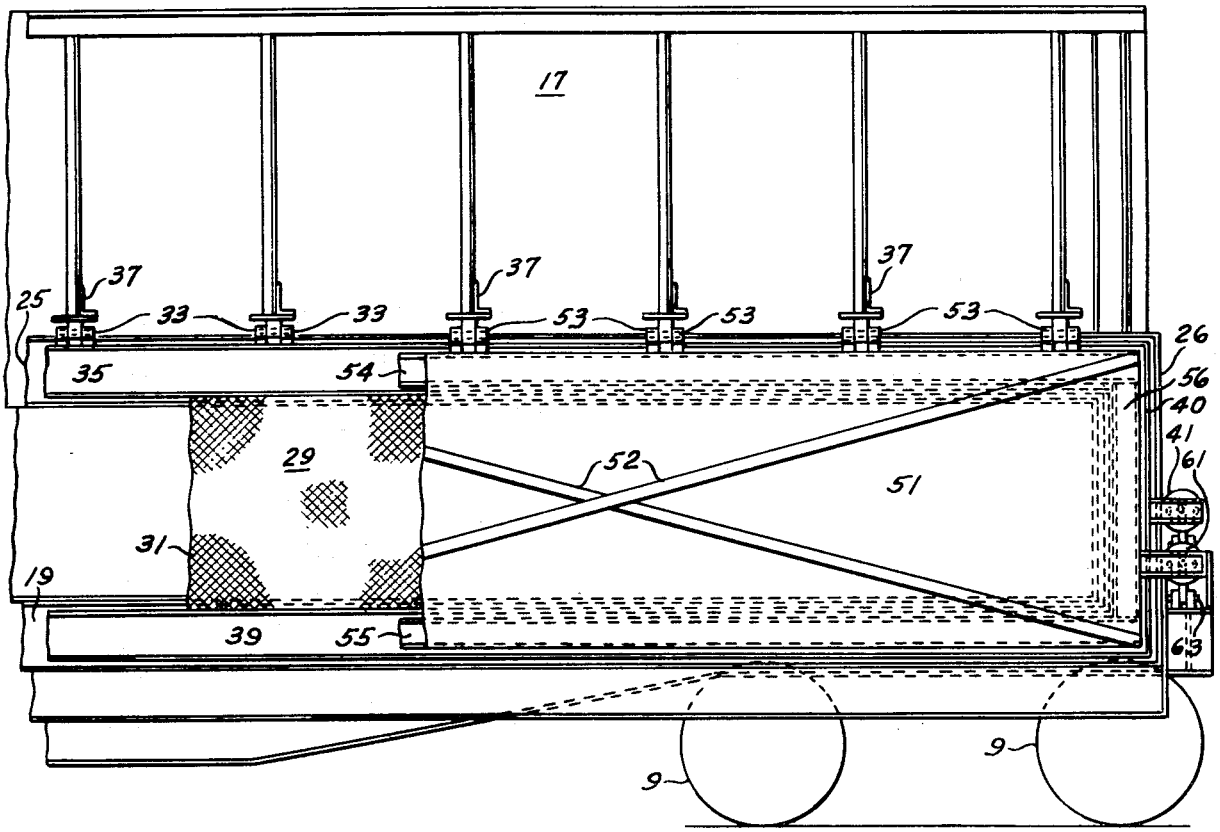
FIG. 4 shows a front view of the car of FIG. 1 with parts removed.

Front wall 17 has a lower edge of channel bar 25 spaced above floor 15 and, as seen in FIG. 4, vertical side channel bars 26 at each end. Thus, front discharge opening 27 has around its perimeter a channel bar comprised of members 19, 25 and 26. Discharge opening 27 extends substantially the whole length of car 1.

Figure 2:
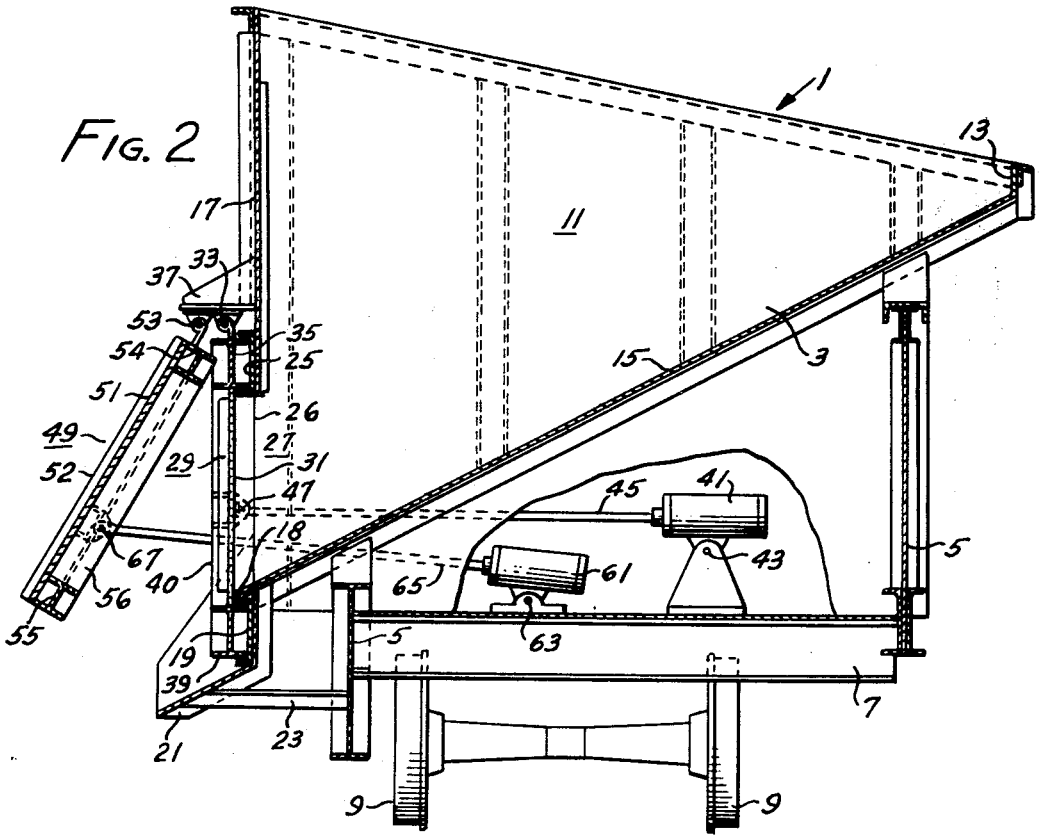
FIG. 2 shows the car of FIG. 1 with the door opened and grate closed.
Figure 3:
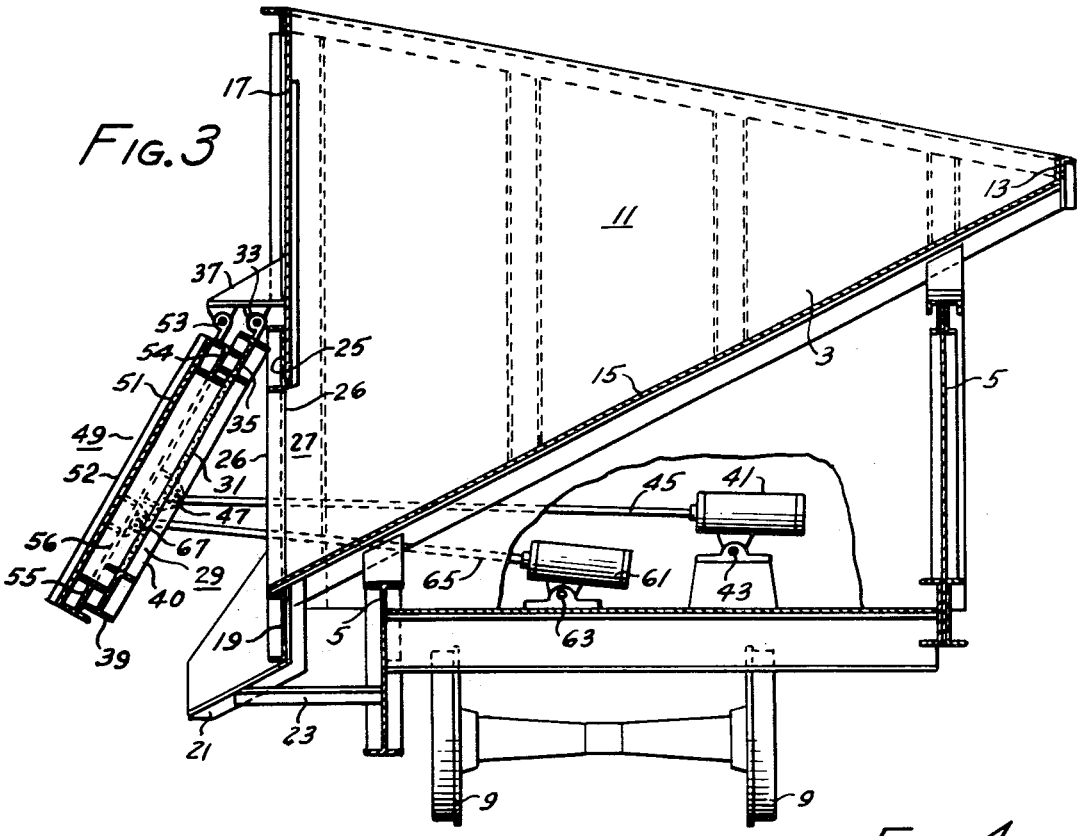
FIG. 3 shows the car of FIG. 1 with the door and grate open.

As seen in FIGS. 1 and 3, grate means shown generally as 29 at discharge opening is movable between an open and closed position. Grate means 29 includes a grate 31 pivotably connected at its upper end to front wall 17 adjacent lower edge of front wall 25 by means of a plurality of hinges 33 connected to I beam 35 and brackets 37 which extend from front wall 17. The grate 31 in the closed position is substantially the same size as discharge opening 27. Grate 31 can be a wire mesh suitable for withstanding the temperature extremes or a perforated plate. Perforations in the plate or mesh are sized to drain quench water but retain coke in basket 3 when grate 31 is closed. Along the lower edge of grate 31 I beam member 39 contacts channel bar 19 when grate 31 is closed, as in FIGS. 1 and 2.

At the upper edge of grate 31, I beam 35 contacts channel bar 25 in substantially liquid-tight fashion when the grate 31 is closed. Along both vertical sides of grate 31, I beams 40 contact channel bars 26 in substantially liquid-tight fashion when grate 31 is closed, as seen in FIGS. 4 and 7. It is thus understood that a first structural shape, I beam member comprised of I beams 35, 39 and 40 is positioned around the edges of grate 31 and contacts the channel bar around the perimeter of discharge opening 27 in substantially liquid-tight fashion, when grate 31 is closed.

Means for opening and closing grate 31 include cylinder 41 pivotably mounted at 43 on the support frame 7. Piston rod 45 moves in response to the urging of cylinder 41. Rod 45 is pivotably connected at each end of grate 31 at 47. When rod 45 is extended, grate 31 is opened, and when rod 47 is retracted, grate 31 is closed. Cylinder 41 is driven by conventional means now shown. Because grate 31 extends substantially the whole car length, I prefer to place a cylinder and rod combination as described above, and shown in FIGS. 3 and 5, at each end of car 1 to operate simultaneously to move grate evenly.

In FIGS. 1 and 2, closure means is shown generally as 49 adjacent grate means 29 for closing discharge opening 27 in substantially liquid-tight condition to retain coke plus water in basket 3. Closure means 49 includes a solid door 51 of suitable plate pivotably connected to front wall 17 outboard of grate 31 by means of a plurality of hinges 53 connected to I beam 54 and brackets 37, as best shown in FIGS. 1 and 4. Brace members 52 are added for rigidity. I beam 54 is positioned along the upper edge of door 51 and contacts I beam 35 of grate 31 in substantially liquid-tight fashion. Along the lower edge of door 51 is positioned I beam 55 which contacts I beam 39 of grate 31 in substantially liquid-tight fashion. Along both vertical edges of door 51 are positioned vertical I beams 56 which contact I beams 40 in substantially liquid-tight fashion, as seen in FIGS. 6 and 7, when door 51 is closed. Thus it can be understood that a second structural shape member comprised of I beams 54, 55, and 56, is formed around the edges of door 51 and which contacts the first structural shape member of grate 31 to form a seal means along the edges of door 51 for providing a substantially liquid-tight seal between door 51 and floor 15 when door 51 is closed. The liquid-tight contact occurs due to the flanges of the respective I beams contacting the web portin of the channels and I beams.

It should be understood that the liquid- or water-tight contact of the sealing means need not be perfect so long as it permits a reservoir of water to be maintained in the basket. Make-up water necessary to maintain the level of the reservoir can be added through the quench system if necessary.

Means for opening and closing closure means 49 includes a cylinder 61 pivotably mounted at 63 on support frame 7. Piston rod 65 moves in response to urging of cylinder 61. Rod 65 is pivotably connected at each end of door 51 at 67. With rod 65 extended, door 51 is opened and when rod 65 is retracted, door 51 is closed. Cylinder 61 is driven by conventional means not shown. Because door 31 extends the length of car 1, I prefer to provide a cylinder and piston rod combinations as described above at each end of car 1 to operate simultaneously to move door 51 evenly. As seen in FIGS. 5 and 6, piston 41 and piston rod 45 are disposed in the same plane but above piston 51 and piston rod 65.

In operation, both door 51 and grate 31 are closed, as shown in FIG. 1 when basket 3 receives the incandescent coke to be quenched. Car 1 moves to a quench site where water flows into basket 3 and is retained therein for a predetermined length of time, quenching the coke thoroughly. After the coke is quenched, door 51 is opened, as shown in FIG. 2, permitting only the water to drain. Car 1 next moves to a coke wharf where both door 51 and grate 31 are opened, as shown in FIG. 3, to dump the coke, and car 1 is ready for another cycle.

FIGS. 8 through 11 show an alternate embodiment of the invention adapted to a tilting bottom discharge coke quench car.

In FIGS. 8 and 9, a coke quench car 101 with a tilting coke basket shown generally as 103 is pivotably mounted at bearing 105 on platform 107 of support frame 109. Support frame 109 is mounted on wheels 111, as is well known. Coke basket 103 includes a pair of spaced end walls 113 connected to frame 109, a front wall 115 extending between end walls 113 rigidly connected to end walls 113 and spaced above frame 109, a floor 117 between end walls 113 above frame pivotably mounted on frame 109, and a back wall 119, extending between end walls 113 rigidly connected to the back edge of floor 117. The general construction of such tilting coke car 101 is well known in the art.

Means for pivoting floor 117 between an open and closed position as well as an intermediate position includes cylinder 121 pivotably mounted at 123 on frame 109, and piston rod 125 which moves in response to the urging of cylinder 121. Rod 125 is pivotably connected to floor 117 at 127 of floor beam 128. When rod 125 is fully extended, floor 117 is tilted to an open position, exposing discharge opening 129, as shown in FIG. 9. Contact member 131 acts as a stop for floor beam 128. When piston rod 125 is fully retracted, floor 117 is tilted to a closed position as shown in FIG. 8. Cylinder 121 is adapted by conventional means not shown to stop the floor 117 at a position intermediate the open and closed positions, which position is hereinafter referred to at the liquid-discharge position. Several such combinations of cylinder 121 and piston rod 125 can be spaced along the car length to assure uniform movement of floor 117.

Along the lower edge of front wall 115 is first sealing means 133, shown in FIG. 11, for providing a substantially liquid or water-tight seal between floor 117 and front wall 115 when floor 117 is in the closed position, to keep coke plus water in basket 103.

First sealing means 133 includes downwardly extending plate 135 at and below the lower edge of front wall 115. Plate 135 has an upper portion 137 adjacent the lower edge. A lip 139 on plate 135 at upper portion 137 is formed by angle iron 141 bolted at 143 to upper portion 137.

Front edge of floor 117 contacts lip 139 in substantially liquid-tight relation when floor 117 is in the closed position as shown in phantom in FIG. 11. Stop 145 bolted at 147 to front wall 115 has perforations 146 therein to permit water but no coke to contact sealing means 133 to water cool the sealing means, when the floor 117 is in the closed position.

As with the previous embodiment the liquid seal need not be perfect so long as it substantially prevents most of the quench water from draining from basket 103 and thereby causes water to be collected in basket 103.

A second sealing means referred to as 149 in FIG. 11 includes a perforated lower portion 151 on plate 135. The perforations are sized to retain coke but drain water when the front edge of floor 117 is adjacent the performations in lower portion 151, in the liquid discharging position, as shown in FIG. 11.

Each side wall 113 has extension 153 slightly below plate 135 so that floor 117 contacts and slides against extension 153 to provide a substantially liquid-tight seal at the car ends when floor 117 is in the closed or liquid discharge position.

Figure 10:
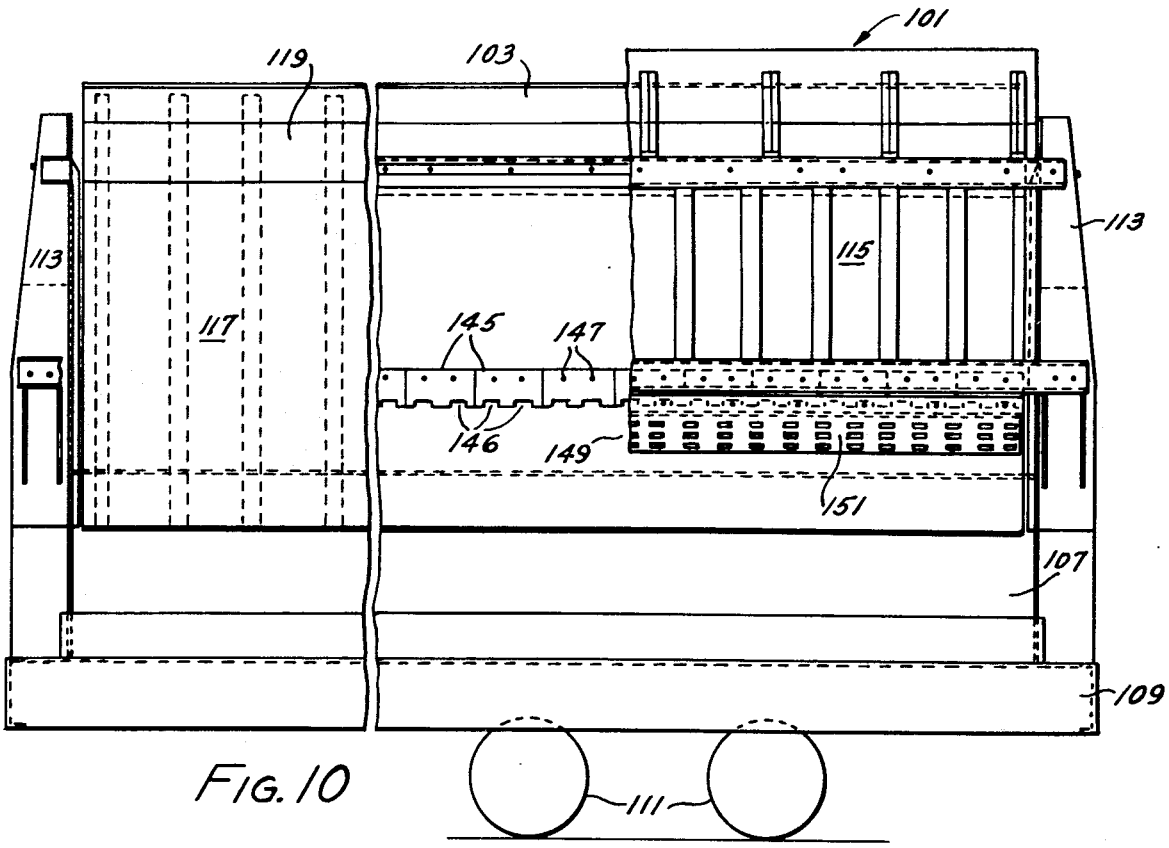
FIG. 10 is a front view of the car of FIG. 8 with parts removed.

FIG. 10 is a front view of car 101, with parts removed, and the floor tilted to the open position as shown in FIG. 9, with coke basket 103 mounted on platform 107 of frame 109. In the right hand portion, front wall 115 is shown with perforated lower portion 151 extending downwardly therefrom. In the middle portion of FIG. 10, a part of front wall 115 is removed exposing stop 145 and perforations 146. In the left hand portion, front wall 115 is entirely removed showing floor 117.

In operation, incandescent coke is charged into the basket 103 with floor 117 in the closed position, as shown in FIG. 8. Car 101 is moved to a quench site and water is either sprayed onto the coke or added through open pipes and accumulates in basket 103 to submerge and quench the coke.

Floor 117 is pivoted to the liquid-discharge position to drain only water, as shown in FIG. 11. Car 101 is moved to a wharf where floor 117 is tilted to the open position, as shown in FIG. 9, to dump the coke, and car 101 is ready for another cycle.

I claim:

1. In a coke quench car having a coke basket with a front wall, and a discharge opening in said front wall, the improvement comprising:

a. channel bar means adjacent the perimeter of said discharge opening;

b. grate means at said discharge opening movable between an open and closed position for discharging liquid and retaining coke in said basket when in the closed position;

i. said grate means including a first contact member means adjacent the edges of said grate means for contacting said channel bar means in substantially liquid-tight fashion;

c. closure means adjacent said grate means;

i. said closure means including a second contact member means adjacent the edges of said closure means for contacting said first contact member means in substantially liquid-tight fashion for retaining coke plus liquid in said basket;

d. first means for opening and closing said closure means; and e. second means for opening and closing said grate means operated to open said grate means when said closure means is opened.

2. The invention of claim 1 in which said grate means includes:

a. a grate pivotably connected at its upper end to said front wall;

b. said grate in the closed position substantially the same size as said discharge opening; and c. said grate having perforations therein sized to drain liquid but retain coke in said basket in the closed position.

3. The invention of claim 2 in which said closure means includes a door pivotable between an open and closed position outboard of said grate means connected at its upper end to said front wall.

4. The invention of claim 3 in which said first and second contact member means include structural shape members.

* * * * *